US008292417B2

(12) United States Patent
Takagi

(10) Patent No.: US 8,292,417 B2
(45) Date of Patent: Oct. 23, 2012

(54) INK CARTRIDGES AND METHODS OF MANUFACTURING SUCH INK CARTRIDGES

(75) Inventor: Yuki Takagi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 321 days.

(21) Appl. No.: 12/325,994

(22) Filed: Dec. 1, 2008

(65) Prior Publication Data

US 2009/0141103 A1 Jun. 4, 2009

(30) Foreign Application Priority Data

Nov. 30, 2007 (JP) ..... 2007-311732
Dec. 1, 2007 (JP) ..... 2007-311822

(51) Int. Cl.
*B41J 2/175* (2006.01)

(52) U.S. Cl. ..... 347/86

(58) Field of Classification Search ..... 347/84, 347/85, 86

See application file for complete search history.

(56) References Cited

U.S. PATENT DOCUMENTS

| | | | | |
|---|---|---|---|---|
| 6,079,823 | A | 6/2000 | Droege | |
| 7,562,972 | B2 * | 7/2009 | Hattori et al. | 347/86 |
| 2007/0070146 | A1 | 3/2007 | Hattori et al. | |
| 2007/0070147 | A1 | 3/2007 | Hattori et al. | |

FOREIGN PATENT DOCUMENTS

| | | | |
|---|---|---|---|
| JP | H07-052399 | A | 2/1995 |
| JP | 2001-510752 | A | 8/2001 |
| JP | 2004-167936 | A | 6/2004 |
| JP | 2004-350971 | A | 12/2004 |
| JP | 2006-095813 | A | 4/2006 |
| JP | 2007-144803 | A | 6/2007 |
| JP | 2007-144808 | A | 6/2007 |

OTHER PUBLICATIONS

Japan Patent Office, Notice of Reasons for Rejection for Japanese Patent Application No. 2007-311822 (counterpart to above-captioned patent application), mailed Mar. 6, 2012.

Japan Patent Office, Decision of Final Rejection for Japanese Patent Application No. 2007-311822 (counterpart to above-captioned patent application), mailed May 22, 2012.

Japan Patent Office, Notice of Reasons for Rejection for Japanese Patent Application No. 2007-311732 (counterpart to above-captioned patent application), mailed Jun. 26, 2012.

* cited by examiner

*Primary Examiner* — Huan Tran
(74) *Attorney, Agent, or Firm* — Baker Botts L.L.P.

(57) ABSTRACT

An ink cartridge includes a case, and the case includes an ink chamber configured to store ink therein, and a particular face facing an exterior of the case and having a first opening formed therethrough. The case also includes an engaging portion positioned at the particular face, and a particular wall extending from a particular portion of the particular face. The particular portion surrounds the first opening, and the particular wall has a tube shape. The particular wall includes an end defining a second opening opposite the first opening. The ink cartridge also includes an elastic member positioned at the end of the particular wall, and a cap. The cap includes an end wall having an third opening formed therethrough, a peripheral wall surrounding each of the elastic member and a portion of the particular wall, and an engaging member extending from the peripheral wall and engaging the engaging portion.

14 Claims, 9 Drawing Sheets

INK CARTRIDGES AND METHODS OF MANUFACTURING SUCH INK CARTRIDGES

CROSS-REFERENCE TO RELATED APPLICATION

The present application claims priority from Japanese Patent Application No. JP-2007-311732, which was filed on Nov. 30, 2007, and Japanese Patent Application No. JP-2007-311822, which was filed on Dec. 1, 2007, the disclosures of which are incorporated herein by reference in their entirety.

BACKGROUND OF THE INVENTION

1. Field of the Invention

The present invention relates generally to ink cartridges configured to be used in an image recording apparatus, and methods of manufacturing such ink cartridges. More specifically, the present invention relates to ink cartridges comprising an elastic member and a cap surrounding the elastic member, and methods of manufacturing such ink cartridges.

2. Description of Related Art

A known ink-jet image recording apparatus has a recording head and an ink supply device configured to supply ink to the recording head. A known ink cartridge is configured to be mounted to the ink supply device. The known ink cartridge has a case, and the case has an ink chamber formed therein. The ink chamber is configured to store ink therein. The case has an ink supply portion, and ink is supplied from an interior of the ink chamber to an exterior of the ink chamber via the ink supply portion. When the known ink cartridge is mounted to the ink supply device, ink stored in the ink chamber is supplied to the recording head via the ink supply portion. The recording head is configured to selectively eject ink toward a sheet of paper, such that an image is recorded on the sheet.

Another known ink cartridge, such as the ink cartridge described in JP-A-2007-144808, has an ink supply portion having a tube-shaped wall extending from a particular face of a case of the ink cartridge. The another known ink cartridge also has an elastic member positioned at the end of the tube-shaped wall. The elastic member has an opening formed therein. When the another known ink cartridge is mounted to the ink supply device, an ink tube of the ink supply device is inserted into the opening of the elastic member. When this occurs, the elastic member elastically deforms and contacts the outer surface of the ink tube liquid-tightly. The another known ink cartridge also has a cap, and the elastic member is sandwiched between the end of the tube-shaped wall and the cap while the elastic member is elastically deformed. The cap has an end wall having an opening formed therein, and a peripheral wall covering a portion of the elastic member and a portion of the tube-shaped wall. When the another known ink cartridge is mounted to the ink supply device, the ink tube is inserted into the opening of the cap and then into the opening of the elastic member. The another known ink cartridge has protrusions extending from the outer surface of the tube-shape wall in radial directions of tube-shaped wall. The peripheral wall of the cap has openings formed therethrough. The protrusions of the ink cartridge are fitted in the openings of the peripheral wall of the cap, respectively, such that the cap is attached to the tube-shaped wall. The peripheral wall of the cap also has slits formed therethrough, and the slits extend in the axial direction of the tube-shaped wall. Because the protrusions extend in the radial directions of tube-shaped wall, the peripheral wall of the cap deforms, such that the diameter thereof increases in the radial directions of tube-shaped wall during the process of attaching the cap to the tube-shaped wall.

Nevertheless, the elastic member may be elastically deformed while being sandwiched between the end of the tube-shaped wall and the cap, such that a portion of the elastic member moves into the openings of the peripheral wall of the cap. Consequently, the elastic member may be deformed unevenly. When the ink tube is inserted into the opening of the elastic member, the contact between the elastic member and the outer surface of the ink tube may not be liquid-tight because of the uneven deformation of the elastic member. In such a case, ink may leak between the elastic member and the ink tube. Moreover, the cap may deform unevenly during the process of attaching the cap to the tube-shaped wall because of the slit formed in the peripheral wall of the cap. This also may cause the uneven deformation of the elastic member.

SUMMARY OF THE INVENTION

Therefore, a need has arisen for ink cartridges and methods of manufacturing such cartridges which overcome these and other shortcomings of the related art. A technical advantage of the present invention is that a contact between an elastic member and an ink tube may be liquid-tight.

According to an embodiment of the present invention, an ink cartridge comprises a case, and the case comprises an ink chamber configured to store ink therein, and a particular face facing an exterior of the case and having a first opening formed therethrough. The case also comprises at least one engaging portion positioned at the particular face, and a particular wall extending from a particular portion of the particular face. The particular portion surrounds the first opening, and the particular wall has a tube shape. The particular wall comprises an end defining a second opening opposite the first opening. The ink cartridge also comprises an elastic member positioned at the end of the particular wall, and a cap. The cap comprises an end wall having an third opening formed therethrough, a peripheral wall surrounding each of the elastic member and at least one portion of the particular wall, and at least one engaging member extending from the peripheral wall and engaging the at least one engaging portion.

According to another embodiment of the present invention, a method of manufacturing an ink cartridge is described. The ink cartridge comprises a case comprising an ink chamber configured to store ink therein, and a particular face facing an exterior of the case and having a first opening formed therethrough. The case also comprises at least one engaging portion positioned at the particular face, at least one guide surface positioned at the particular face, and a particular wall extending from a particular portion of the particular face in a particular direction. The particular portion surrounds the first opening, and the particular wall has a tube shape. The particular wall comprises an end defining a second opening opposite the first opening. The ink cartridge also comprises an elastic member positioned at the end of the particular wall, and a cap. The cap comprises an end wall having an third opening formed therethrough, in which the second opening and the third opening are aligned in the particular direction, a peripheral wall surrounding each of the elastic member and at least one portion of the particular wall, and at least one engaging member extending from the peripheral wall and engaging the at least one engaging portion. The method comprises the steps of contacting the at least one engaging member with the at least one guide surface, and pressing the at least one engaging member against the at least one engaging portion.

Other objects, features, and advantages of embodiments of the present invention will be apparent to persons of ordinary skill in the art from the following description of embodiments with reference to the accompanying drawings.

BRIEF DESCRIPTION OF DRAWINGS

For a more complete understanding of the present invention, the needs satisfied thereby, and the objects, features, and advantages thereof, reference now is made to the following description taken in connection with the accompanying drawings.

DETAILED DESCRIPTION OF EMBODIMENTS

Figure 1B:
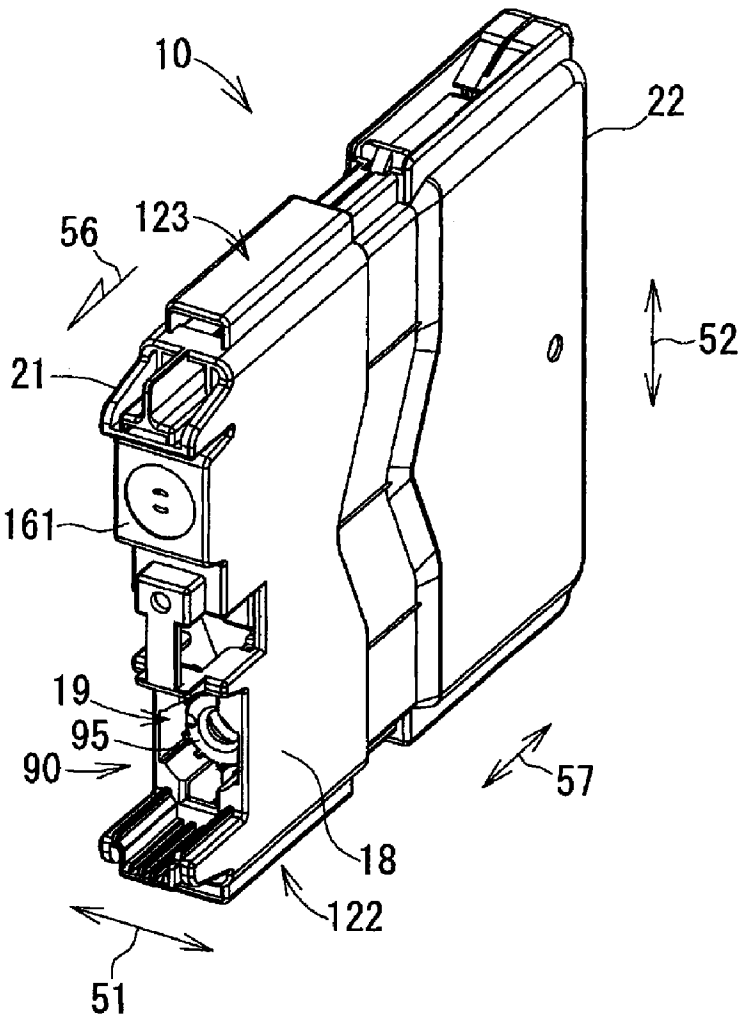
FIGS. 1(A) and 1(B) are perspective views of an ink cartridge according to an embodiment of the present invention in which a first cover of the ink cartridge is in a second position and a first position, respectively.

Embodiments of the present invention and their features and technical advantages may be understood by referring to FIGS. 1-9, like numerals being used for like corresponding portions in the various drawings.

Referring to FIGS. 1(A)-3, an ink cartridge 10 according to an embodiment of the present invention is described. Ink cartridge 10 may be configured to be used with an ink-jet image recording apparatus (not shown). The ink-jet image recording apparatus may comprise a recording head (not shown) and an ink supply device configured to supply ink to the recording head. The ink supply device may comprise a mounting portion (not shown), and ink cartridge 10 may be configured to removably mounted to the mounting portion.

Ink cartridge 10 may have a flattened, substantially rectangular parallelepiped shape having a width in a width direction 51, a height in a height direction 52, and a depth in a depth direction 57. The width of ink cartridge 10 may be less than each of the height of ink cartridge 10 and the depth of ink cartridge 10.

Ink cartridge 10 may be inserted into the mounting portion in an insertion direction 56, which is parallel to depth direction 57. Ink cartridge 10 may comprise a top face 123 and a bottom face 122 opposite top face 123. When ink cartridge 10 is mounted to the mounting portion, ink cartridge 10 is in a position depicted in FIG. 1, i.e., top face 123 is positioned at the top of ink cartridge 10, and bottom face 122 is positioned at the bottom of ink cartridge 10.

Ink cartridge 10 may comprise a case 20, a first cover 21, and a second cover 22. First cover 21 and second cover 22 may substantially define an entirety of the outer appearance of ink cartridge 10. Case 20 may comprise ink chamber 100 formed therein, and ink chamber 100 may be configured to store ink therein. First cover 21 and second cover 22 may enclose substantially the entirety of case 20. In this embodiment, case 20, first cover 21, and second cover 22 may comprise a resin material, such as nylon, polyethylene, polypropylene, or any combination thereof.

Figure 2:
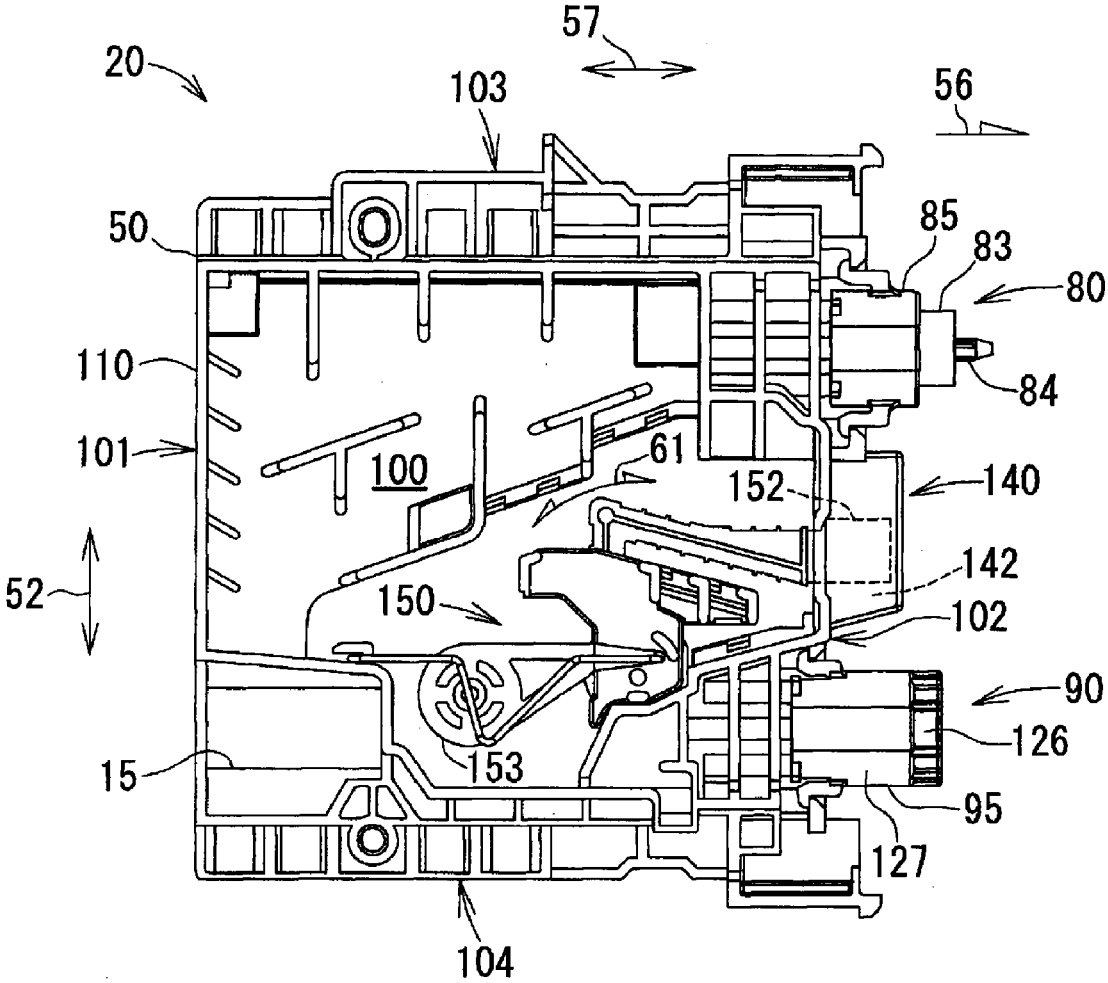
FIG. 2 is a side view a case of the ink cartridge of FIGS. 1(A) and 1(B).
Figure 3:
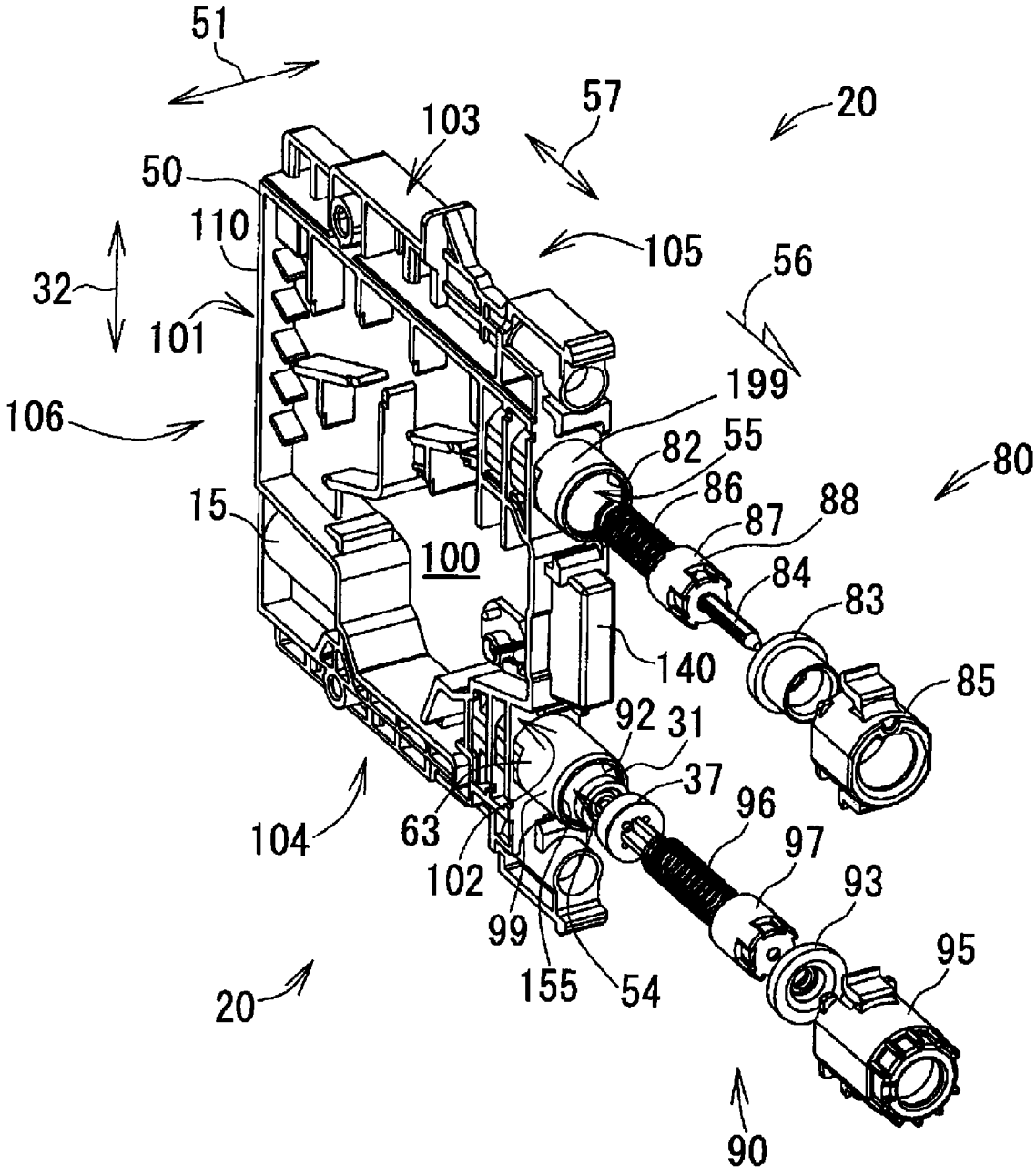
FIG. 3 is an exploded, perspective view of the case of FIG. 2, in which a pivotable member is omitted.

Referring to FIGS. 2 and 3, case 20 may comprise a front face 102, a rear face 101 positioned opposite front wall 102, a top face 103 extending between front face 102 and rear face 101, a bottom face 104 extending between front face 102 and rear face 101 and positioned opposite top face 103, a left face 105 extending between front face 102 and rear face 101, and a right face 106 extending between front face 102 and rear face 101 and positioned opposite left face 105. Each of front face 102, rear face 101, top face 103, bottom face 104, left face 105, and right face 106 may face the exterior of case 20, and may define the outer appearance of case 20. When ink cartridge 10 is inserted into the mounting portion, case 20 may be inserted from a front face 102 side. When the ink cartridge 10 is mounted to the mounting portion and is used in the image recording apparatus, top face 103 is positioned at the top of case 20 and bottom face 104 is positioned at the bottom of case 20. Each of an area of left face 105 and an area of right face 106 may be greater than each of an area of front face 102, an area of rear face 101, an area of top face 103, and an area of bottom face 104.

Ink cartridge 10 also may comprise an air communication valve mechanism 80, an ink supply valve mechanism 90, and a pivotable member 150.

Case 20 may comprise a frame 110 and a pair of films (not shown). Frame 110 may comprise front face 102, rear face 101, top face 103, and bottom face 104. The pair of films may comprise left face 105 and right face 106.

Frame 110 may comprise a translucent resin material, e.g., a transparent or semi-transparent resin material, such as polyacetal, nylon, polyethylene, polypropylene, or the like, and may be manufactured by injection molding the resin material.

Frame 110 may have a substantially rectangular profile extending along front face 102, top face 103, rear face 101, and bottom face 104, forming a space inside. As a result, a pair of openings may be formed at widthwise ends of the frame 110, respectively.

The pair of films may be attached, e.g., welded or bonded with adhesive, to the widthwise ends of frame 110, respectively, such that the openings are covered by the pair of films, respectively. Frame 110 and the pair of films may define an ink chamber 100 therein. Ink chamber 100 may be configured to store ink therein. In another embodiment, a frame may be a container having six rigid walls, and an ink chamber may be formed in the container.

Referring to FIGS. 2 and 3, frame 110 may comprise an ink filling portion 15 positioned at rear face 101. Ink filling portion 15 may comprise substantially a circular, cylindrical chamber extending from rear surface 101 toward ink chamber 100. The cylindrical chamber of ink filling portion 15 may be configured to be in fluid communication with ink chamber 100. When ink cartridge 10 is manufactured, ink may be introduced into ink chamber 100 via ink filling portion 15, such that ink chamber 100 is filled with ink.

Case 20 may comprise a detection portion 140 extending from front face 102 away from ink chamber 100. The amount of ink stored in ink chamber 100 may be visually or optically detected via detection portion 140. Detection portion 140 may be integral with frame 110. Therefore, detection portion 140 may comprise the same material as frame 110, i.e., a translucent resin material, e.g., a transparent or semi-transparent resin material. Light may pass through detection portion 140. When ink cartridge 10 is mounted to the mounting portion, detection portion 140 may be irradiated with light emitted from an optical sensor, i.e., a photo-interrupter, positioned in the mounting portion. Detection portion 140 may have an inner space 142 formed therein. Inner space 142 may be continuous with ink chamber 100.

Pivotable member 150 may be positioned in ink chamber 100. Pivotable member 150 may comprise an indicator portion 152 at one end of pivotable member 150. Indicator portion 152 may be positioned in inner space 142, and may be configured to move in inner space 142. Pivotable member 150 may comprise a float portion 153 at another end of pivotable member 150. Pivotable member 150 may be pivotably supported by case 20 at a position between indicator portion 152 and float portion 153, such that pivotable member 150 pivots in directions indicated by an arrow 61 in FIG. 2. The specific gravity of float portion 153 may be less than the specific gravity of ink stored in ink chamber 100. For example, float portion 153 may comprise a hollow formed therein, such that the specific gravity of float portion 153 is less than the specific gravity of ink stored in ink chamber 100. Therefore, float portion 153 may be configured to float on ink and move up and down when the amount of ink in ink chamber 100 increases and decreases, respectively. Pivotable member 150 may pivot in accordance with the movement of float portion 153, and indicator portion 152 may move in inner space 142 in accordance with the pivotal movement of pivotable member 150. The position of indicator portion 152 in inner space 142 may be detected by the optical sensor, or detected visually, from the exterior of detection portion 140. It may be determined whether the amount of ink in ink chamber 100 is greater than or equal to a predetermined amount of ink, based on the detection of the position of indicator portion 152.

Figure 1A:
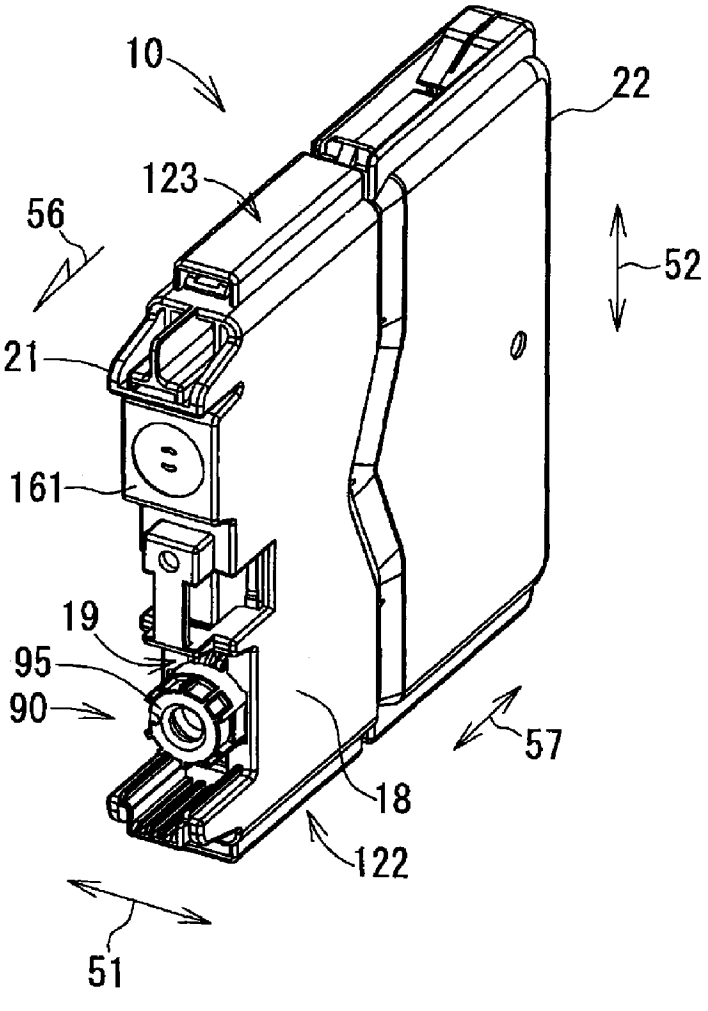

Referring to FIGS. 1(A) and 1(B), first cover 21 may have a container shape and may accommodate a front portion of case 20 with respect to insertion direction 56, i.e., first cover 21 may accommodate front face 102 side of case 20. Second cover 22 may have a container shape and may accommodate a rear portion of case 20 with respect to insertion direction 56, i.e., second cover 22 may accommodate rear face 101 side of case 20. Accordingly, the front portion of case 20 may be protected by first cover 21, and the rear portion of case 20 may be protected by second cover 22.

First cover 21 may comprise a front wall 161 facing front face 102 of case 20, and an opening 19 may be formed through front wall 161. First cover 21 may be configured to slide in depth direction 57 with respect to second cover 22. In FIG. 1(A), first cover 21 is in a second position in which front wall 161 is positioned closest to front face 102 of case 20 within the sliding range of first cover 21. In FIG. 1(B), first cover 21 is in a first position in which front wall 161 is positioned furthest from front face 102 of case 20 within the sliding range of first cover 21.

Coil springs (not shown) may be positioned between front wall 161 of first cover 21 and front face 102 of case 20. The coil springs may apply a biasing force to first cover 21 toward the first position. Accordingly, when no external force is applied to first cover 21, the coil springs may bias first cover 21 into the first position. When an external force is applied to first cover 21 against the biasing force of the coil springs, first cover 21 may move from the first position to the second position.

Figure 4:
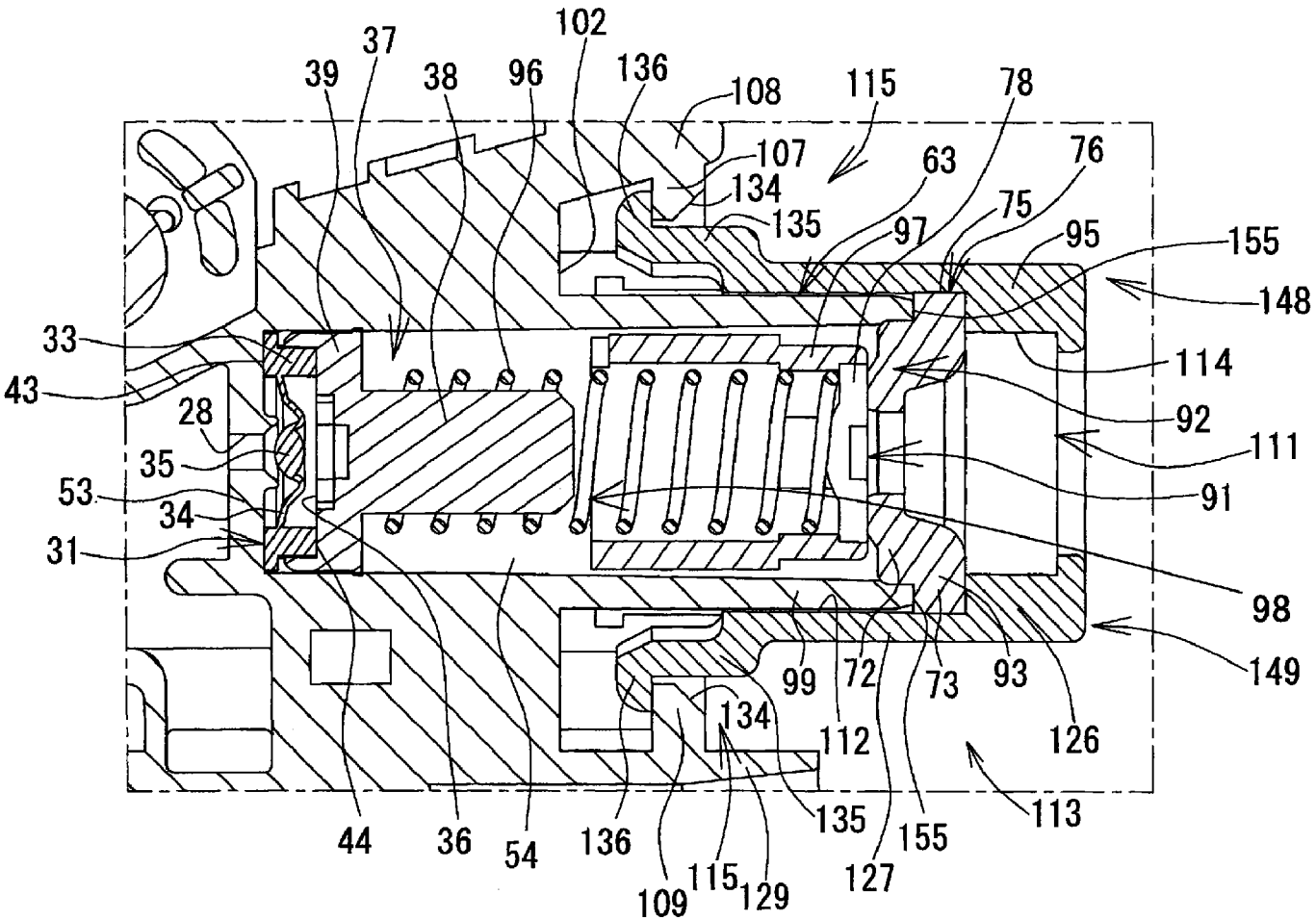
FIG. 4 is a partial, cross-sectional view of the case of FIG. 2, showing a structure adjacent to an ink supply wall of the case, in which an ink supply opening is covered.

Referring to FIG. 4, an opening 98 may be formed through front face 102 of case 20. Opening 98 may be positioned closer to bottom face 104 than to top face 103. Referring to FIGS. 3 and 4, case 20 may comprise an ink supply wall 99 extending from a portion of front face 102, which portion surrounds opening 98, toward the exterior of case 20 in depth direction 57. Ink supply wall 99 may have a tube shape, e.g., a circular, cylindrical tube shape. In another embodiment, ink supply wall 99 may have a rectangular, cylindrical tube shape. Referring to FIG. 4, a valve chamber 54 may be formed in ink supply wall 99, and valve chamber 54 may extend from the interior of ink supply wall 99 to the interior of case 20 beyond front face 102 via opening 98. Valve chamber 54 may extend in depth direction 57. In this embodiment, valve chamber 54 may have a circular, cylindrical shape. Case 20 may comprise an end wall 53 defining the inner most end of valve chamber 54, and an opening 28 may be formed through end wall 53. Valve chamber 54 is configured to be in fluid communication with ink chamber 100 via opening 28. At least a portion of ink supply valve mechanism 90 may be accommodated in valve chamber 54.

Referring to FIGS. 3 and 4, an opening 92 may be formed at an end 155 of ink supply wall 99 opposite opening 98. Ink supply valve mechanism 90 may be configured to selectively allow and prevent fluid communication between the interior of ink chamber 100 and the exterior of case 20 via opening 92 and valve chamber 54. Ink supply valve mechanism 90 may comprise a first valve element 31, a valve seat 37, a coil spring 96, a second valve element 97, a sealing member 93, and a cap 95. Each of first valve element 31, valve seat 37, coil spring 96, second valve element 97, sealing member 93, and cap 95 may comprise a resin, such as polyacetal or silicon rubber.

First valve element 31, valve seat 37, coil spring 96, second valve element 97, sealing member 93, and cap 95 may be sequentially aligned in depth direction 57 and may contact each other. First valve element 31, valve seat 37, coil spring 96, and second valve element 97 may be accommodated in valve chamber 54. Sealing member 93 and cap 95 may be positioned at end 155 of ink supply wall 99.

Figure 5:
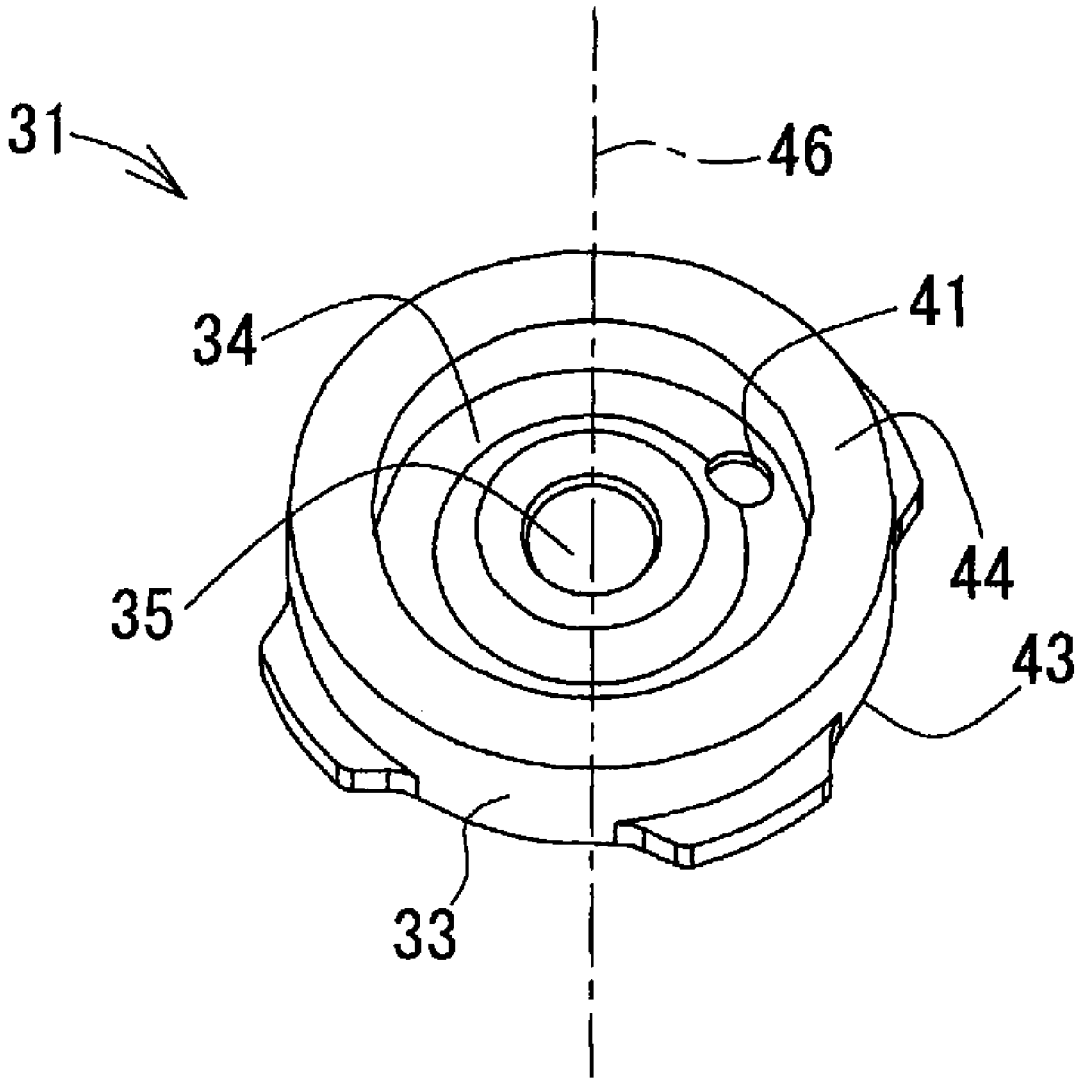
FIG. 5 is a perspective view of a first valve element.
Figure 6:
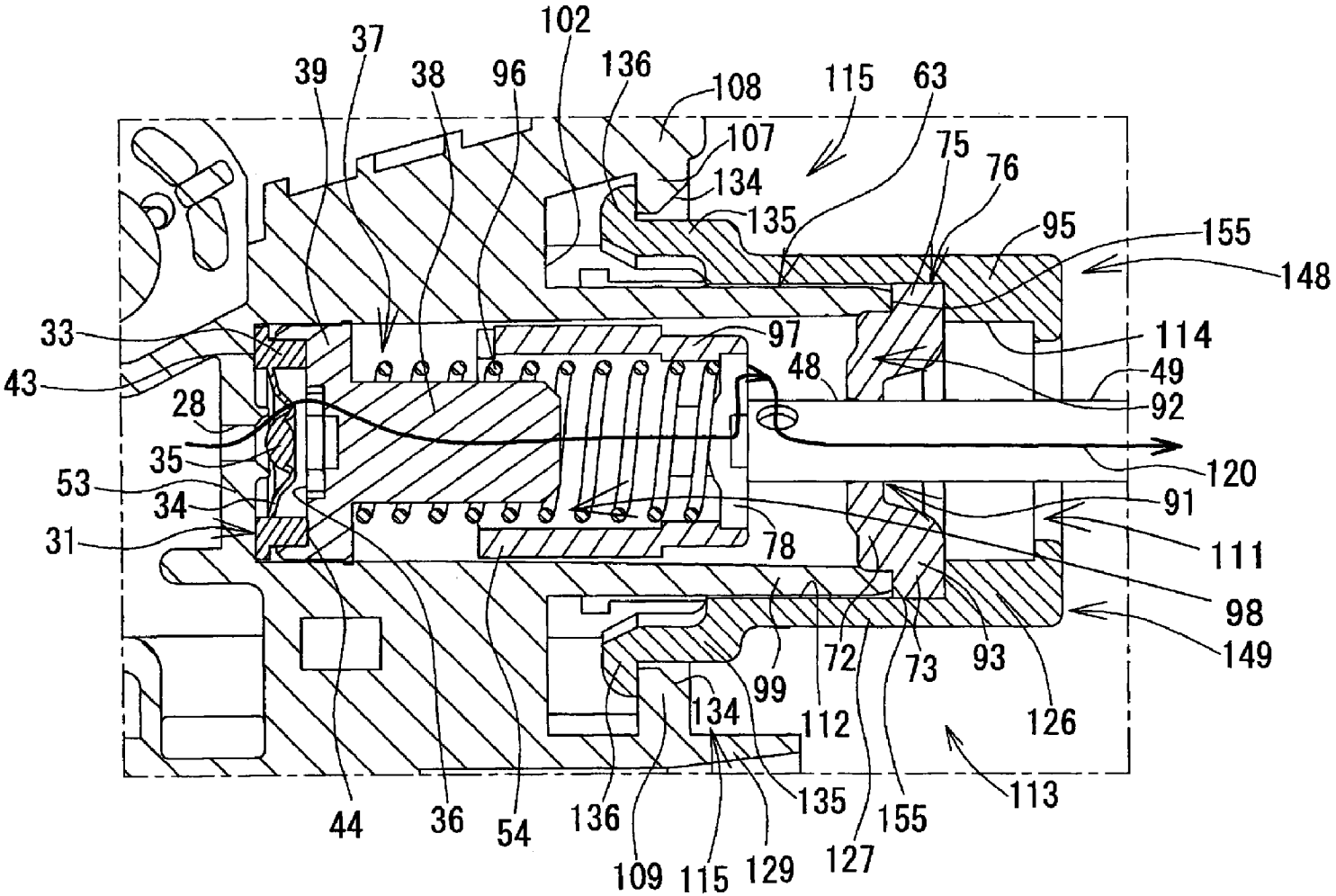
FIG. 6 is a partial, cross-sectional view of the case of FIG. 2, showing a structure adjacent to the ink supply wall of the case, in which the ink supply opening is uncovered.

Referring to FIG. 5, first valve element 31 may comprise a first side 43 and a second side 44 opposite first side 43. Referring to FIG. 4, first valve element 31 may be positioned in valve chamber 54, such that first side 43 contacts end wall 53 and second side 44 contacts valve seat 37. First valve element 31 may be configured to selectively cover and uncover opening 28 formed through end wall 53. First valve element 31 may be manufactured by injection-molding silicon rubber, for example.

Referring to FIG. 5, first valve element 31 may comprise a circular, cylindrical member 33, an inner wall 34, and a lid member 35. Referring to FIG. 4, circular, cylindrical member 33 may receive a biasing force from coil spring 96 via valve seat 37. The biasing force may bring circular, cylindrical member 33 into tight contact with end wall 53. Referring to FIG. 5, inner wall 34 may extend in a direction intersecting a center line 46 of circular, cylindrical member 33 inside circular, cylindrical member 33. Center line 46 may be parallel to depth direction 57. Referring to FIG. 4, inner wall 34 may be bent in a cross sectional view. In this embodiment, inner wall 34 may be a relatively thin wall comprising silicon rubber, such that inner wall 34 is flexible. Therefore, inner wall 34 readily may deform when inner wall 34 receives pressure from ink. Referring to FIG. 5, an opening 41 may be formed through inner wall 34 in a direction parallel to center line 46. Ink may pass through opening 41 when ink flows from ink chamber 100 into valve chamber 54. Lid member 35 may be positioned at the center of inner wall 34. Lid member 35 may selectively cover and uncover opening 28 of end wall 53. In this embodiment, lid member 35 may have a spherical shape.

Referring to FIG. 4, valve seat 37 may be manufactured by injection-molding a polypropylene resin. Valve seat 37 may comprise a valve seat base portion 38 and a valve element receiving portion 39. Valve seat base portion 38 may have a circular, cylindrical rod shape extending from the center of a circular surface of valve element receiving portion 39 in depth direction 57. The outer diameter of the valve seat base portion 38 may be slightly less than the inner diameter of the coil spring 96. Valve seat base portion 38 may be inserted into coil spring 96. Accordingly, coil spring 96 may be supported by the valve seat base portion 38, such that coil spring 96 is configured to expand and to contract in the direction in which valve seat base portion 38 extends, i.e., in depth direction 57. An end of coil spring 96 may contact the circular surface of valve element receiving portion 39.

Valve element receiving portion 39 may receive and contact first valve element 31. Valve element receiving portion 39 may have a circular, cylindrical shape. The outer diameter of valve element receiving portion 39 may be slightly less than the diameter of valve chamber 54. Valve element receiving portion 39 may have a circular, cylindrical recess 36 formed therein. First valve element 31 may be fitted in recess 36. The diameter of recess 36 may be slightly greater than the outer diameter of circular, cylindrical member 33 of first valve element 31. The depth of recess 36 may be substantially equal to the thickness of circular, cylindrical member 33 in a direction parallel to center line 46, i.e., in depth direction 57. An opening may be formed through a bottom surface of recess 36, such that ink may pass therethrough. Valve seat 37 may press circular, cylindrical member 33 of first valve element 31 toward end wall 53 upon reception of the biasing force of coil spring 96.

When ink in valve chamber 54 flows toward ink chamber 100, the ink may press inner wall 34 of first valve element 31, such that inner wall 34 deforms to move lid member 35 toward opening 28. When lid member 35 contacts end wall 53 and covers opening 28, ink may be prevented from flowing from valve chamber 54 to ink chamber 100. When ink in ink chamber 100 flows into valve chamber 54, the ink may flow through opening 28 and press inner wall 34, such that inner wall 34 deforms to move lid member 35 away from end wall 53. Accordingly, opening 28 may be uncovered. As such, ink may flow from ink chamber 100 via opening 28, opening 41, and the opening formed through the bottom surface of recess 36 into valve chamber 54.

Referring to FIG. 4, second valve element 97 may be configured to move in depth direction 57. Second valve element 97 may comprise a wall 78 configured to contact seal member 93. Coil spring 96 may be positioned between valve element receiving portion 39 of valve seat 37 and wall 78 of second valve element 97 while being compressed. Coil spring 96 may bias valve element receiving portion 39, such that circular, cylindrical member 33 of first valve element 31 contacts end wall 53 tightly. Coil spring 96 may bias second valve element 97 toward sealing member 93, such that wall 78 of second valve element 97 contacts sealing member 93.

Sealing member 93 may comprise an elastic material, such as rubber, such that sealing member 93 is configured to elastically deform. Sealing member 93 may comprise a first circular, cylindrical portion 72 fitted into valve chamber 54 via opening 92, and a second circular, cylindrical portion 73 which is in contact with end 155 of ink supply wall 99 defining opening 92. The outer diameter of first circular, cylindrical portion 72 may be substantially equal to the diameter of valve chamber 54. The outer diameter of second circular, cylindrical portion 73 may be greater than the diameter of valve chamber 54, and may be substantially equal to the inner diameter of an inner surface 112 of cap 95. Cap 95 may be attached to case 20, such that cap 95 presses sealing member 93 against end 155 of ink supply wall 99 defining opening 92. Accordingly, sealing member 93 elastically may deform and liquid-tightly contact end 155 of ink supply wall 99. Moreover, because second circular, cylindrical portion 73 is sandwiched and pressed between cap 95 and end 155 of ink supply wall 99, second circular, cylindrical portion 73 elastically may expand, such that the diameter thereof increases. Accordingly, an outer surface 76 of second circular, cylindrical portion 73 may liquid-tightly contact inner surface 112 of cap 95.

An ink supply opening 91 may be formed through the center of first circular, cylindrical portion 72 and the center of second circular, cylindrical portion 73. Opening 91 may have substantially a circular, conical shape. Coil spring 96 may bias second valve element 97 toward sealing member 93, such that wall 78 of second valve element 97 contacts sealing member 93 and covers opening 91. Therefore, fluid communication between the interior of ink chamber 100 and the exterior of case 20 via opening 91 and valve chamber 54 may be prevented. When an external force is applied to second valve element 97 against the biasing force of coil spring 96, second valve element 97 may move away from sealing member 93, and opening 91 may be uncovered. Consequently, fluid communication between the interior of ink chamber 100 and the exterior of case 20 via opening 91 and valve chamber 54 may be allowed.

Referring to FIGS. 7(A)-9, cap 95 may comprise a cap body 113 and engaging members 115. Cap body 113 may comprise an end wall 125, a first peripheral wall 126, and a second peripheral wall 127. End wall 125 may have a disk shape, and may define an end of cap 95. An opening 111 may be formed through end wall 125. Opening 92 and opening 111 may be aligned in depth direction 57.

Figure 7B:
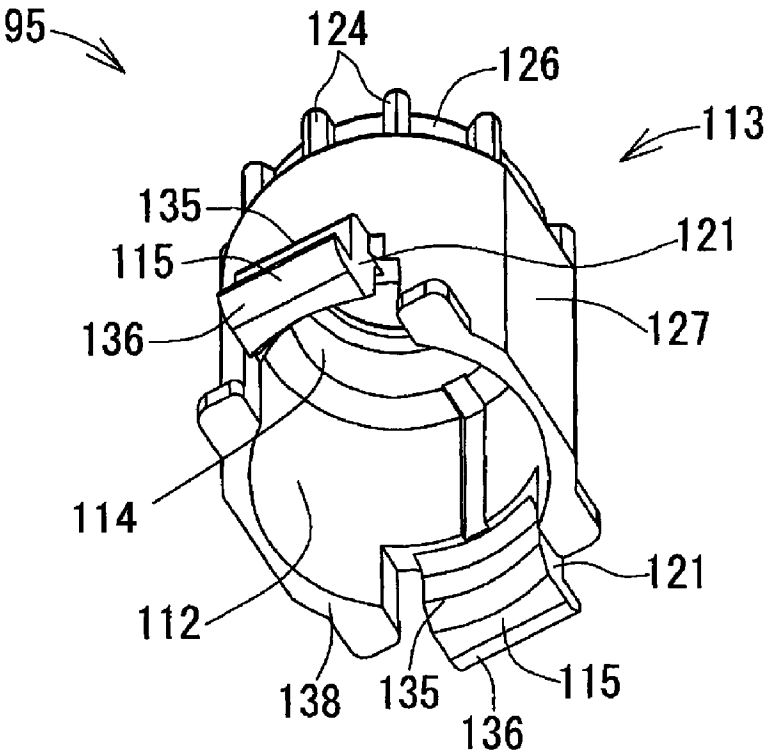
FIGS. 7(A) and 7(B) are perspective views of a cap.
Figure 7A:
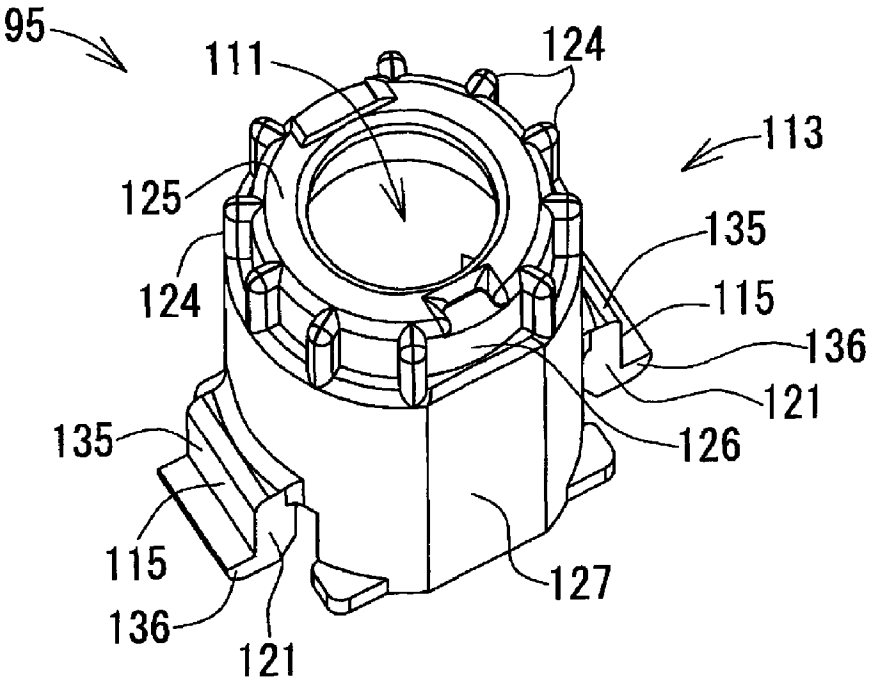
Figure 8:
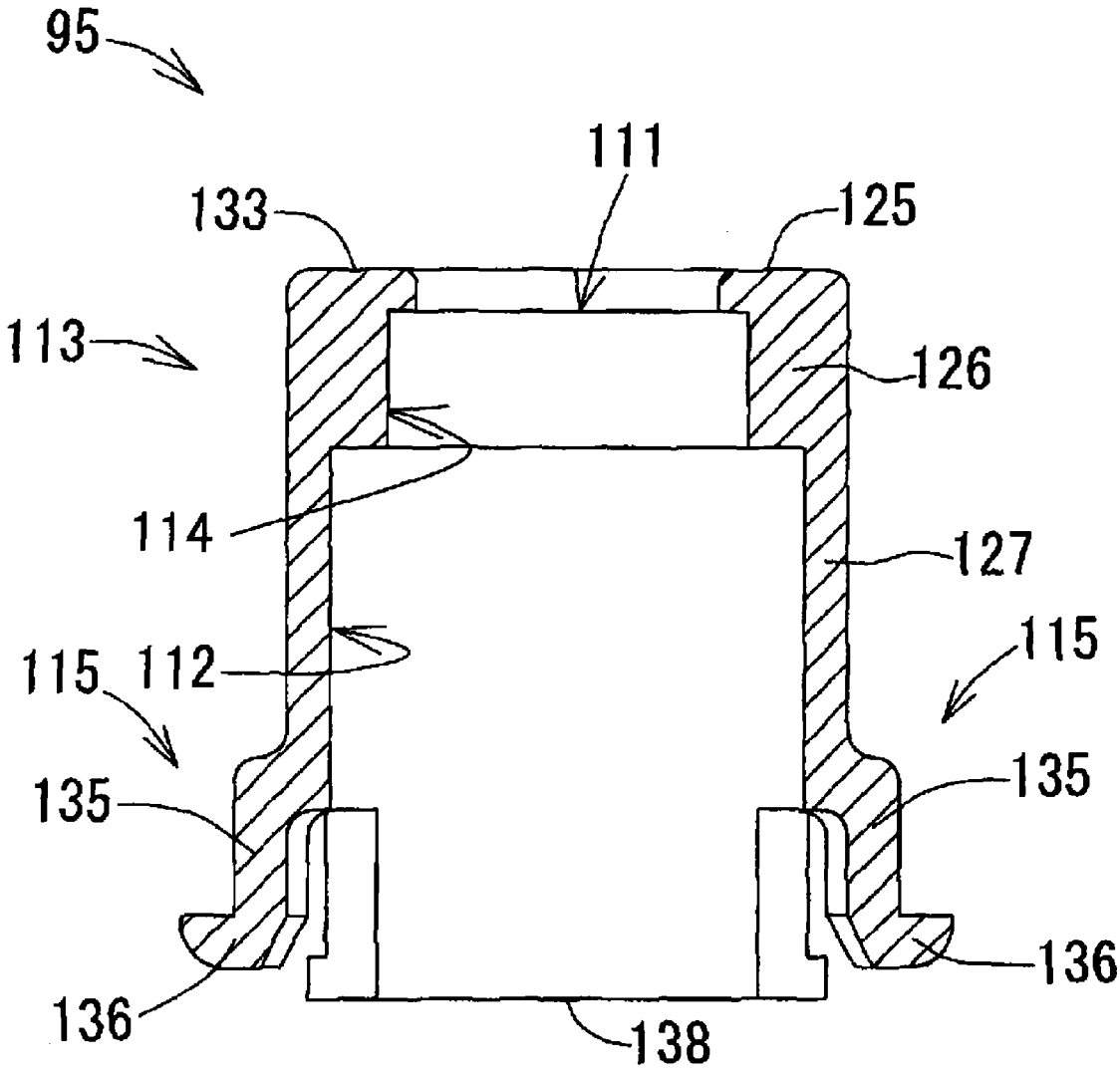
FIG. 8 is a cross-sectional view of the cap of FIGS. 7(A) and 7(B).

First peripheral wall 126 may extend from a peripheral edge of end wall 125. First peripheral wall 126 may comprise an outer surface having a circular, cylindrical shape, and an inner surface 114 having a circular, cylindrical shape. The outer diameter of first peripheral wall 126 may be less than the outer diameter of second peripheral wall 127. The inner diameter of first peripheral wall 126 may be slightly less than the diameter of valve chamber 54. The thickness of the first peripheral wall 126 may be greater than the thickness of second peripheral wall 127 in the radial direction of cap body 113, which is perpendicular to depth direction 57. Cap 95 may comprise a plurality of, e.g., ten, ribs 124 on the outer surface of first peripheral wall 126. Ribs 124 may be aligned in the circumferential direction of first peripheral wall 126 at a predetermined interval. Ribs 124 may extend outward from the outer surface of the first peripheral wall 126 in radial directions of first peripheral wall 126, which are perpendicular to depth direction 57, and may extend in the axial direction of first peripheral wall 126, which is parallel to depth direction 57. Referring to FIG. 7(A), ends of ribs 124 may be flush with an outer surface of second peripheral wall 127, and ribs 124 may be connected to second peripheral wall 127. Ribs 124 may reinforce the rigidity of end wall 125, first peripheral wall 126, and second peripheral wall 127.

Second peripheral wall 127 may be connected to the first peripheral wall 126. Second peripheral wall 127 may comprise an outer surface having substantially a circular, cylindrical shape, and inner surface 112 having a circular, cylindrical shape. The inner diameter of second peripheral wall 127 may be substantially equal to the outer diameter of ink supply wall 99 and the outer diameter of second circular, cylindrical portion 73 of sealing member 93. At least a portion of an outer surface 63 of ink supply wall 99 and outer surface 76 of second circular, cylindrical portion 73 of sealing member 93 may be surrounded and covered by second peripheral wall 127. Sealing member 93 may be pressed by first peripheral wall 126 of cap 95 against end 155 of ink supply wall 99, and may elastically deform, such that the diameter of sealing member 93 increases. Accordingly, second circular, cylindrical portion 73 of sealing member 93 contacts end 155 of ink supply wall 99, and outer surface 76 of second circular, cylindrical portion 73 of sealing member 93 may tightly contact inner surface 112 of second peripheral wall 127.

Second peripheral wall 127 may comprise a first portion surrounding and covering sealing member 93, and a second portion surrounding and covering at least a portion of ink supply wall 99. The first portion of second peripheral wall 127 may not have any openings formed therethrough in the radial direction of second peripheral wall 127, such that the entirety of outer surface 76 of second circular, cylindrical portion 73 of sealing member 93 may be surrounded and covered by the first portion of second peripheral wall 127. The radial direction of second peripheral wall 127 is perpendicular to the axial direction of second peripheral wall 127, and the axial direction of second peripheral wall 127 is parallel to depth direction 57.

Referring to FIG. 7(A)-9, engaging members 115 may extend from the outer surface of second peripheral wall 127. In this embodiment, two engaging members 115 may be positioned on the outer surface of second peripheral wall 127, such that the center axis of second peripheral wall 127 is positioned between the thus engaging members 115. Each engaging member 115 may comprise an elastically deforming portion 135 and a hook portion 136. Elastically deforming portion 135 may have substantially an L-shape which first extends outward from the outer surface of second peripheral wall 127 in the radial direction of second peripheral wall 127, which is perpendicular to depth direction 57, and then extends toward an end 138 of the cap 95, which is opposite from end wall 125, in the axial direction of second peripheral wall 127, which is parallel to depth direction 57. Hook portion 136 may extend outward in the radial direction of second peripheral wall 127 from an end of elastically deforming portion 135. Elastically deforming portion 135 may be configured to elastically deform to bend with respect to the outer surface of second peripheral wall 127, such that hook portion 136 moves outward and inward in the radial direction of second peripheral wall 127.

Figure 9:
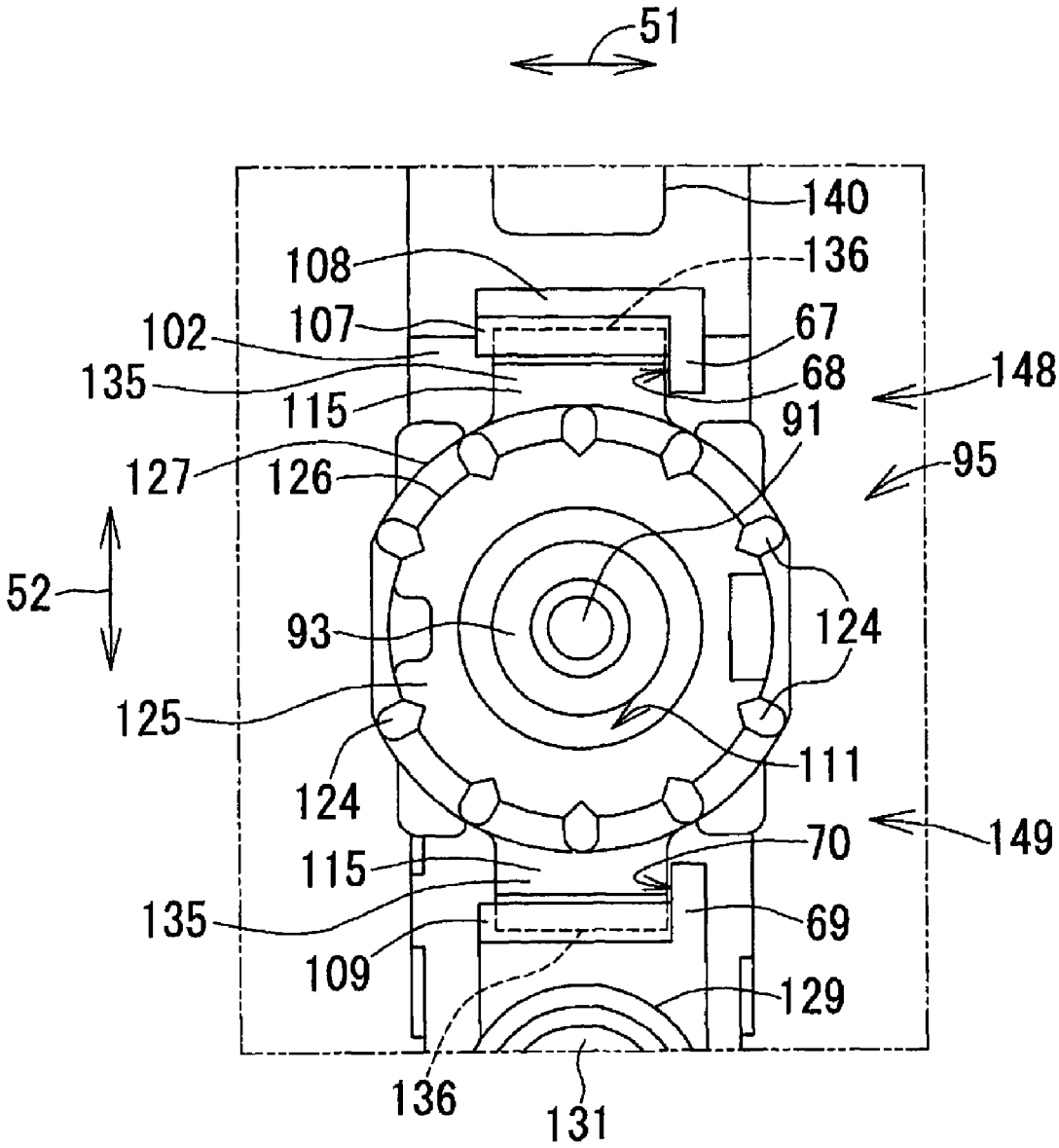
FIG. 9 is a partial, front view of the case of FIG. 2, showing a structure adjacent to the cap of FIGS. 7(A) and 7(B).

Referring to FIGS. 4 and 9, case 20 may comprise engaging portions 107 and 109 at front face 102 at positions corresponding to hook portions 136 of cap 95, respectively. Hook portions 136 may engage engaging portions 107 and 109, respectively. Engaging portion 107 may extend toward bottom face 104 and toward outer surface 63 of ink supply wall 99 from a wall 108 extending from front face 102. Engaging portion 109 may extend toward top face 102 and toward outer surface 63 of ink supply wall 99 from a wall 129 extending from front face 102.

Referring to FIG. 9, case 20 may comprise guide members 67 and 69 positioned adjacent to engaging portions 107 and 109, respectively. Guide members 67 and 69 may be configured to guide engaging members 115 toward the engaging portions 107 and 109, respectively, when cap 95 is attached to case 20 during the manufacture of ink cartridge 10. Guide members 67 and 69 may be positioned further outward from front face 102 than engaging portions 107 and 109 are positioned from front face 102. Guide members 67 and 69 may comprise guide surfaces 68 and 70 configured to contact elastically deforming portions 135 and hook portions 136.

Referring to FIGS. 4 and 9, when ink cartridge 10 is manufactured, cap 95 may be attached to case 20 from an end 138 side. Hook portions 136 may be brought into contact with guide surfaces 68 and 70. Subsequently, when cap 95 is pressed toward front face 102, hook portions 136 may be pressed against engaging portions 107 and 109. When this occurs, elastically deforming portions 135 may elastically deform toward outer surface 63 of ink supply wall 99, and hook portions 136 may move over engaging portions 107 and 109 along inclined surfaces 134 of engaging portions 107 and 109. When cap 95 is further pressed toward front face 102, hook portions 136 may return to their original positions by the elasticity of the elastically deforming portions 135, such that hook portions 136 and engaging portions 107 and 109 are engaged. Accordingly, referring to FIGS. 4 and 9, cap 95 is attached to case 20, such that ink supply wall 99 is positioned between engaging members 115 in height direction 52. One of engaging members 115 may be positioned in a position 148 between ink supply wall 99 and top face 103, and the other of engaging members 115 may be positioned in a position 149 between ink supply wall 99 and bottom wall 104.

Referring to FIGS. 1(A) and 1(B), when first cover 21 is in the first position, cap 95 may be positioned in the interior of first cover 21, as shown in FIG. 1(B). When first cover 21 moves from the first position to the second position, cap 95 may pass through opening 19, and when first cover 21 is in the second position, cap 95 may be positioned in the exterior of first cover 21, as shown in FIG. 1(A). The diameter of opening 19 may be slightly greater than the outer diameter of second peripheral wall 127 of cap 95.

Referring to FIG. 3, case 20 may comprise air communication wall 199 extending from a portion of front face 102, which portion is positioned closer to top face 103 than to bottom face 104, toward the exterior of case 20 in depth direction 57. Air communication wall 199 may have a tube shape, e.g., a circular, cylindrical tube shape. Valve chamber 55 may be formed in air communication wall 199, and valve chamber 55 may extend from the interior of air communication wall 199 to the interior of case 20 beyond front face 102. Valve chamber 55 may extend in depth direction 57. In this embodiment, valve chamber 55 may have a circular, cylindrical shape. Valve chamber 55 may be configured to be in fluid communication with ink chamber 100. At least a portion of air communication valve mechanism 80 may be accommodated in valve chamber 55.

An opening 82 may be formed at an end of air communication wall 199. Air communication valve mechanism 80 may be configured to selectively allow and prevent fluid communication between the interior of ink chamber 100 and the exterior of case 20 via opening 82 and valve chamber 55. Air communication valve mechanism 80 may comprise a coil spring 86, a valve element 87, a sealing member 83, and a cap 85. Each of coil spring 86, valve element 87, sealing member 83, and cap 85 may comprise a resin, such as polyacetal or silicon rubber.

Coil spring 86, valve element 87, sealing member 83, and cap 85 may be sequentially aligned in depth direction 53 and may contact each other. Coil spring 86 and valve element 87 may be accommodated in valve chamber 55. Sealing member 83 and cap 85 may be positioned at a portion of air communication wall 199 defining opening 82.

Valve element 87 may be configured to move in depth direction 57. Valve body 87 may comprise a lid member 88 and a rod 84. Rod 84 may extend from the center of lid member 88 to the exterior of case 20 via opening 82. Cap 85 may be attached to front face 102, such that sealing member 83 is sandwiched between cap 85 and the portion of air communication wall 199 defining opening 82. Each of cap 85 and sealing member 83 may have an opening formed therethrough. Rod 84 also may extend via the openings of cap 85 and sealing member 83.

Coil spring 86 may be configured to apply a biasing force to valve element 87 toward sealing member 83. Therefore, lid member 88 may contact sealing member 83 and cover the opening of sealing member 83, such that fluid communication between the interior of ink chamber 100 and the exterior of case 20 via opening 82 and valve chamber 55 is prevented. When an external force is applied to rod 84 against the biasing force of coil spring 86, rod 84 may move toward valve chamber 55. Accordingly, lid member 88 of valve element 87 may move away from sealing member 83, and the opening of sealing member 83 may be uncovered. Consequently, fluid communication between the interior of ink chamber 100 and the exterior of case 20 via opening 82 and valve chamber 55 may be allowed. When this occurs, air may flow into ink chamber 100 via opening 82 and valve chamber 55, and consequently, the pressure in ink chamber 100 may become equal to the atmospheric pressure.

Referring to FIGS. 1(A) and 1(B), when first cover 21 is in the first position, rod 84 may be positioned in the interior of first cover 21 away from front wall 161. When first cover 21 moves from the first position to the second position, rod 84 may contact front wall 161 and may be pressed toward valve chamber 55, and when first cover 21 is in the second position, that lid member 88 of valve element 87 may be positioned away from sealing member 83, and the opening of sealing member 83 may be uncovered.

When ink cartridge 10 is inserted into the mounting portion, first cover 21 may contact a portion of the mounting portion and may be pressed against the portion of the mounting portion, such that first cover 21 moves from the first position to the second position. When this occurs, rod 84 may be pressed by first cover 21, such that lid member 88 of valve element 87 moves away from sealing member 83, and the opening of sealing member 83 is uncovered. Consequently, fluid communication between the interior of ink chamber 100 and the exterior of case 20 via opening 82 and valve chamber 55 may be allowed. Moreover, referring to FIG. 6, cap 95 may emerge from the interior of first cover 21 to the exterior of first cover 21, and an ink tube 49 positioned in the mounting portion may be inserted into opening 111 of cap 95. The outer diameter of ink tube 49 may be less than the diameter of opening 111.

When ink cartridge 10 is further inserted into the mounting portion, ink tube 49 may be inserted into ink supply opening 91, and an end of ink tube 49 may contact second valve element 97. The diameter of ink tube 49 may be greater than the smallest diameter of ink supply opening 91. Therefore, when ink tube 49 is inserted into ink supply opening 91, sealing member 93 elastically may deform and liquid-tightly contact the outer surface of ink tube 49. When ink cartridge 10 is further inserted into the mounting portion, second valve element 97 may be pressed by ink tube 49 against the biasing force of coil spring 96, and may move away from sealing member 93. Accordingly, ink supply opening 91 is uncovered. When this occurs, ink tube 49 may enable valve chamber 54 to be in fluid communication with the exterior of case 20 via ink supply opening 91 and opening 110, such that ink in the ink chamber 100 may be supplied to the recording head via an ink path 120 extending via opening 28, opening 41, the opening of valve element receiving portion 39, valve chamber 54, and ink tube 49.

As described above, because engaging members 115 engage engaging portions 107 and 109, first peripheral wall 126 and second peripheral wall 127 may not need to have openings formed therethrough in the radial directions of first peripheral wall 126 and second peripheral wall 127 to attach cap 95 to case 20. Therefore, sealing member 93 may deform evenly while being sandwiched between end 155 of ink supply wall 99 and cap 95, and while contacting inner surface 112 of cap 95.

Moreover, because elastically deforming portion 135 of engaging member 115 is configured to elastically deform, cap body 113 may not deform during the process of attaching cap 95 to case 20. Therefore, sealing member 93 may deform evenly.

While the invention has been described in connection with various exemplary structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. An ink cartridge comprising:

a case comprising:

an ink chamber configured to store ink therein;

a particular face facing an exterior of the case and having a first opening formed therethrough, wherein the particular face comprises a particular portion surrounding the first opening;

a particular wall extending from the particular portion, wherein the particular wall has a tube shape, wherein the particular wall comprises an end defining a second opening opposite the first opening; and at least one engaging portion extending from the particular face and separate from the particular wall;

an elastic member positioned at the end of the particular wall; and a cap comprising:

an end wall having an third opening formed therethrough;

a peripheral wall surrounding each of the elastic member and at least one portion of the particular wall; and at least one engaging member extending from the peripheral wall and engaging the at least one engaging portion.

2. The ink cartridge of claim 1, wherein the particular wall extends from the particular portion of the particular face in a particular direction, and the second opening and the third opening are aligned in the particular direction.

3. The ink cartridge of claim 1, wherein the at least one engaging member is configured to elastically deform.

4. The ink cartridge of claim 1, wherein the elastic member contacts the end of the particular wall.

5. The ink cartridge of claim 4, wherein the peripheral wall comprises an inner surface, and the elastic member contacts the inner surface.

6. The ink cartridge of claim 1, wherein the elastic member is sandwiched between the end of the particular wall and the cap.

7. The ink cartridge of claim 1, wherein a portion of the elastic member is positioned in an interior of the particular wall.

8. The ink cartridge of claim 1, wherein the elastic member has a fourth opening formed therethrough.

9. The ink cartridge of claim 1, wherein the at least one engaging portion comprises a first engaging portion and a second engaging portion, and the at least one engaging member comprises a first engaging member and a second engaging member which engage the first engaging portion and the second engaging portion, respectively, wherein the particular wall is positioned between the first engaging member and the second engaging member.

10. The ink cartridge of claim 1, wherein the particular wall extends from the particular portion of the particular face in a particular direction, and the peripheral wall comprises a first portion surrounding the elastic member and a second portion surrounding the at least one portion of the particular wall, wherein the first portion of the peripheral wall has no opening formed therethrough in a radial direction of the peripheral wall, wherein the radial direction of the peripheral wall is perpendicular to an axial direction of the peripheral wall, and the axial direction of the peripheral wall is parallel to the particular direction.

11. The ink cartridge of claim 1, wherein the at least one engaging member is positioned between the at least one engaging portion and the particular wall.

12. A method of manufacturing an ink cartridge comprising:

a case comprising:

an ink chamber configured to store ink therein;

a particular face facing an exterior of the case and having a first opening formed therethrough, wherein the particular face comprises a particular portion surrounding the first opening;

at least one guide surface positioned at the particular face; and a particular wall extending from the particular portion in a particular direction, wherein the particular wall has a tube shape, wherein the particular wall comprises an end defining a second opening opposite the first opening; and at least one engaging portion extending from the particular face and separate from the particular wall;

an elastic member positioned at the end of the particular wall; and a cap comprising:

an end wall having an third opening formed therethrough, wherein the second opening and the third opening are aligned in the particular direction;

a peripheral wall surrounding each of the elastic member and at least one portion of the particular wall; and at least one engaging member extending from the peripheral wall and engaging the at least one engaging portion, the method comprising the steps of:

contacting the at least one engaging member with the at least one guide surface; and pressing the at least one engaging member against the at least one engaging portion.

13. The method of claim 12, further comprising the step of elastically deforming the at least one engaging member.

14. The method of claim 12, wherein the at least one engaging member is positioned between the at least one engaging portion and the particular wall.

* * * * *